US011096855B2

(12) United States Patent
Wang et al.

(10) Patent No.: US 11,096,855 B2
(45) Date of Patent: Aug. 24, 2021

(54) REHABILITATION TRAINING APPARATUS FOR ANKLE JOINT

(71) Applicant: Chunbao Wang, Shenzhen (CN)

(72) Inventors: Chunbao Wang, Shenzhen (CN); Lihong Duan, Shenzhen (CN); Quanquan Liu, Shenzhen (CN); Yajing Shen, Shenzhen (CN); Wanfeng Shang, Shenzhen (CN); Zhuohua Lin, Shenzhen (CN); Tongyang Sun, Shenzhen (CN); Jinfeng Xia, Shenzhen (CN); Zhengdi Sun, Shenzhen (CN); Xiaojiao Chen, Shenzhen (CN); Weiguang Li, Shenzhen (CN); Zhengzhi Wu, Shenzhen (CN); Yulong Wang, Shenzhen (CN); Jianjun Long, Shenzhen (CN)

(73) Assignee: Chunbao Wang, Guangdong (CN)

( * ) Notice: Subject to any disclaimer, the term of this patent is extended or adjusted under 35 U.S.C. 154(b) by 640 days.

(21) Appl. No.: 15/781,684

(22) PCT Filed: Apr. 19, 2017

(86) PCT No.: PCT/CN2017/081018
§ 371 (c)(1),
(2) Date: Jun. 5, 2018

(87) PCT Pub. No.: WO2018/191876
PCT Pub. Date: Oct. 25, 2018

(65) Prior Publication Data

US 2019/0060152 A1 Feb. 28, 2019

(51) Int. Cl.
*A61H 1/00* (2006.01)
*A61H 1/02* (2006.01)

(52) U.S. Cl.
CPC ..... *A61H 1/005* (2013.01); *A61H 1/00* (2013.01); *A61H 1/02* (2013.01); *A61H 1/0266* (2013.01);
(Continued)

(58) Field of Classification Search
USPC ..... 601/23, 46, 84; 606/56, 58, 130; 434/247, 255, 258
See application file for complete search history.

(56) References Cited

U.S. PATENT DOCUMENTS 4,452,447 A * 6/1984 Lepley ..... A63B 21/00845 36/11.5
5,203,321 A * 4/1993 Donovan ..... A61H 1/0266 482/79
(Continued)

FOREIGN PATENT DOCUMENTS

CN 103041546 A 4/2013
CN 105030479 A 11/2015
(Continued)

OTHER PUBLICATIONS

European Search Report issued in EP17872874.7, dated Oct. 21, 2020 (8 pages).
(Continued)

*Primary Examiner* — Justine R Yu
*Assistant Examiner* — Matthew D Ziegler
(74) *Attorney, Agent, or Firm* — Wilmer Cutler Pickering Hale and Dorr LLP

(57) ABSTRACT

Provided is a rehabilitation training apparatus for an ankle joint. The rehabilitation training apparatus comprises a working platform, a Z-axis rotating mechanism, a Y-axis rotating mechanism, an X-axis rotating mechanism, and a pedal. The Y-axis rotating mechanism includes an annular bracket vertically fastened to a driving arm of the Z-axis
(Continued)

rotating mechanism, an annular sliding cover slidably disposed on one side wall of the annular bracket, a Y-axis driving mechanism for driving the annular sliding cover to rotate around the axis of the annular bracket, and a sliding block for locating the annular sliding cover. The Y-axis driving mechanism synchronously rotates with the annular sliding cover and the X-axis rotating mechanism is fastened to one side of the annular sliding cover.

7 Claims, 4 Drawing Sheets

(52) U.S. Cl.
CPC .. *A61H 2201/1207* (2013.01); *A61H 2201/14* (2013.01); *A61H 2201/164* (2013.01); *A61H 2201/1642* (2013.01); *A61H 2201/1673* (2013.01); *A61H 2201/5058* (2013.01); *A61H 2201/5061* (2013.01); *A61H 2205/12* (2013.01)

(56) References Cited

U.S. PATENT DOCUMENTS 5,372,597 A * 12/1994 Hotchkiss ..... A61B 17/6425 602/20
5,376,091 A * 12/1994 Hotchkiss ..... A61B 17/62 602/22
5,399,147 A * 3/1995 Kaiser ..... A61H 1/0255 601/16
5,897,464 A * 4/1999 Mcleod ..... A63B 23/08 482/132
6,007,500 A * 12/1999 Quintinskie, Jr. ... A61H 1/0281 601/33
7,452,342 B2 * 11/2008 Bonutti ..... A61F 5/0102 602/16
7,862,524 B2 * 1/2011 Carignan ..... B25J 17/025 601/5
8,251,935 B2 * 8/2012 Bonutti ..... A61F 5/00 602/23
8,795,139 B2 * 8/2014 Zhang ..... A63B 71/0054 482/52
9,730,852 B2 * 8/2017 Malosio ..... A61H 1/005
10,123,929 B2 * 11/2018 Celik ..... A63B 21/0058
10,667,938 B2 * 6/2020 Bonutti ..... A61F 5/013
2004/0243025 A1 * 12/2004 Peles ..... A61H 1/0277 601/5
2005/0137065 A1 * 6/2005 Zoller ..... A63B 23/08 482/117
2009/0305850 A1 * 12/2009 Shiraishi ..... A63B 22/14 482/52
2012/0310121 A1 12/2012 Bonutti et al.
2016/0175182 A1 6/2016 Hubschmid

FOREIGN PATENT DOCUMENTS

CN 205094938 U 3/2016
CN 205108257 U 3/2016
CN 105853142 A 8/2016
CN 304090644 S 3/2017
CN 106924014 A 7/2017
EP 1870791 B1 3/2006
JP 2010279596 A 12/2010

OTHER PUBLICATIONS

International Search Report issued by the Chinese Patent Office in International Application No. PCT/CN2017/081018, dated Jan. 17, 2018 (4 pages).

* cited by examiner

REHABILITATION TRAINING APPARATUS FOR ANKLE JOINT

This application is a national stage application of International Application No. PCT/CN2017/081018, entitled "Rehabilitation Training Apparatus," filed Apr. 19, 2017, the disclosure of which is hereby incorporated by reference herein in its entirety.

TECHNICAL FIELD

The present disclosure relates to the technical field of medical apparatuses, and for example, relates to a rehabilitation training apparatus for an ankle joint.

BACKGROUND

An aging problem in China is increasingly serious, and hemiplegia has high incidence in old people. Therefore, rehabilitation treatment for hemiplegia of old people is very important. Since a hemiplegic patient with ankle dorsiflexion obstacle cannot overcome foot drop in a walking swing phase and rehabilitation of walking capability is seriously affected, rehabilitation of the ankle joint has important significance to holistic rehabilitation of the hemiplegic patient.

A traditional rehabilitation means to the hemiplegic patient is conducted by a physical therapist by hand, consuming a lot of time and physical strength and not ensuring adequate training time and adequate training intensity.

SUMMARY

The present disclosure provides a rehabilitation training apparatus for an ankle joint, which has high automation degree and can realize multi-freedom movement of the ankle joint.

Embodiments of the present disclosure provide a rehabilitation training apparatus for an ankle joint, including: a working platform, a Z-axis rotating mechanism erected on the working platform and rotating around a Z axis of the working platform, a Y-axis rotating mechanism connected with the Z-axis rotating mechanism and rotating around a Y axis of the working platform, an X-axis rotating mechanism connected with the Y-axis rotating mechanism and rotating around an X axis of the working platform, and a pedal arranged on a lower end of the X-axis rotating mechanism and parallel to a desktop of the working platform; where the Y-axis rotating mechanism includes an annular bracket vertically fastened to a driving arm of the Z-axis rotating mechanism, an annular sliding cover slidably disposed on one side wall of the annular bracket, a Y-axis driving mechanism for driving the annular sliding cover to rotate around the axis of the annular bracket, and a sliding block for locating the annular sliding cover, where the Y-axis driving mechanism synchronously rotates with the annular sliding cover and the X-axis rotating mechanism is fastened to one side of the annular sliding cover.

In some embodiments, a bracket wall of the annular bracket is radially provided with an arc-shaped long groove; a groove wall of the arc-shaped long groove is provided with a rack; and the rack engages with a driving wheel of the Y-axis driving mechanism.

In some embodiments, a locating seat inwards extends on an inner side wall of the annular sliding cover; the locating seat is fastened to the Y-axis driving mechanism; and the Y-axis driving mechanism is arranged oppositely to the X-axis rotating mechanism.

In some embodiments, a plurality of locating bulges are evenly arranged along a circumferential direction on an inner side wall of the annular sliding cover; and the locating bulges are fastened to the sliding block for locating the annular sliding cover.

In some embodiments, a plurality of first balls are annularly and evenly arranged between the annular sliding cover and the annular bracket.

In some embodiments, the sliding block has an L-shaped cross section; a first side wall of the sliding block is located at an outer side of the annular bracket and a plurality of second balls are annularly and evenly arranged between the first side wall and the annular bracket; and an end of a second side wall of the sliding block is fastened to the locating bulges.

In some embodiments, the X-axis rotating mechanism includes a base, an arc-shaped sliding rail in sliding fit with a slipway at one side of the base, an X-axis driving mechanism arranged in the base and used for driving the arc-shaped sliding rail to reciprocate upwards and downwards along the slipway, and a supporting beam horizontally extending on a lower end of the arc-shaped sliding rail and used for erecting the pedal.

In some embodiments, the pedal is horizontally erected on the supporting beam.

In some embodiments, a plurality of third balls are evenly arranged between side walls of the arc-shaped sliding rail and between side walls of the slipway.

In some embodiments, the Z-axis rotating mechanism includes a driving motor, a fan-shaped driving handle connected with a power output end of the driving motor, a driving shaft buried in the working platform and engaging with the fan-shaped driving handle, a torque sensor fitting an upper end of the driving shaft, and a driving arm of the Z-axis rotating mechanism fastened to the torque sensor.

The embodiments of the present disclosure provide a rehabilitation training apparatus for an ankle joint, including the working platform, the Z-axis rotating mechanism erected on the working platform and rotating around a Z axis of the working platform, the Y-axis rotating mechanism connected with the Z-axis rotating mechanism and rotating around a Y axis of the working platform, the X-axis rotating mechanism connected with the Y-axis rotating mechanism and rotating around an X axis of the working platform, and the pedal arranged on the lower end of the X-axis rotating mechanism and parallel to a desktop of the working platform; where the Y-axis rotating mechanism includes the annular bracket vertically fastened to the driving arm of the Z-axis rotating mechanism, the annular sliding cover slidably disposed on one side wall of the annular bracket, the Y-axis driving mechanism for driving the annular sliding cover to rotate around the axis of the annular bracket, and the sliding block for locating the annular sliding cover, wherein the Y-axis driving mechanism synchronously rotates with the annular sliding cover and the X-axis rotating mechanism is fastened to one side of the annular sliding cover. The adoption of the above structural design enables to achieve multi-freedom movement of the ankle joint conveniently and rapidly, thus effectively increasing rehabilitation training efficiency.

DETAILED DESCRIPTION

Figure 1:
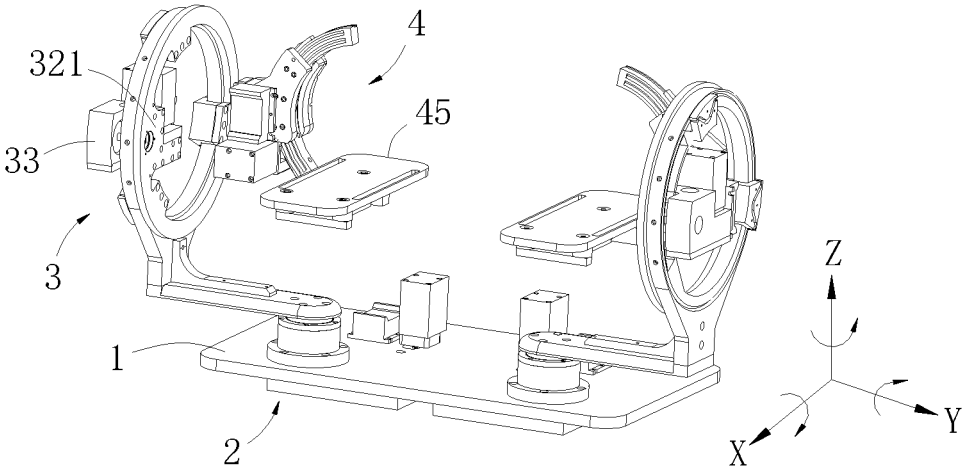
FIG. 1 is an axonometric diagram illustrating a rehabilitation training apparatus for an ankle joint in the present embodiment.

As shown in FIG. 1, a rehabilitation training apparatus for an ankle joint in the present embodiment includes: a working platform 1, a Z-axis rotating mechanism 2 erected on the working platform 1 and rotating around a Z axis of the working platform, a Y-axis rotating mechanism 3 connected with the Z-axis rotating mechanism 2 and rotating around a Y axis of the working platform, an X-axis rotating mechanism 4 connected with the Y-axis rotating mechanism 3 and rotating around an X axis of the working platform, and a pedal 45 arranged on a lower end of the X-axis rotating mechanism 4 and parallel to a desktop of the working platform 1. The Y-axis rotating mechanism 3 includes an annular bracket 31 vertically fastened to a driving arm 24 of the Z-axis rotating mechanism 2, an annular sliding cover 32 slidably disposed on one side wall of the annular bracket 31, a Y-axis driving mechanism 33 for driving the annular sliding cover 32 to rotate around the axis of the annular bracket 31, and a sliding block 34 for locating the annular sliding cover 32. The Y-axis driving mechanism 33 synchronously rotates with the annular sliding cover 32. The X-axis rotating mechanism 4 is fastened to one side of the annular sliding cover 32.

Figure 2:
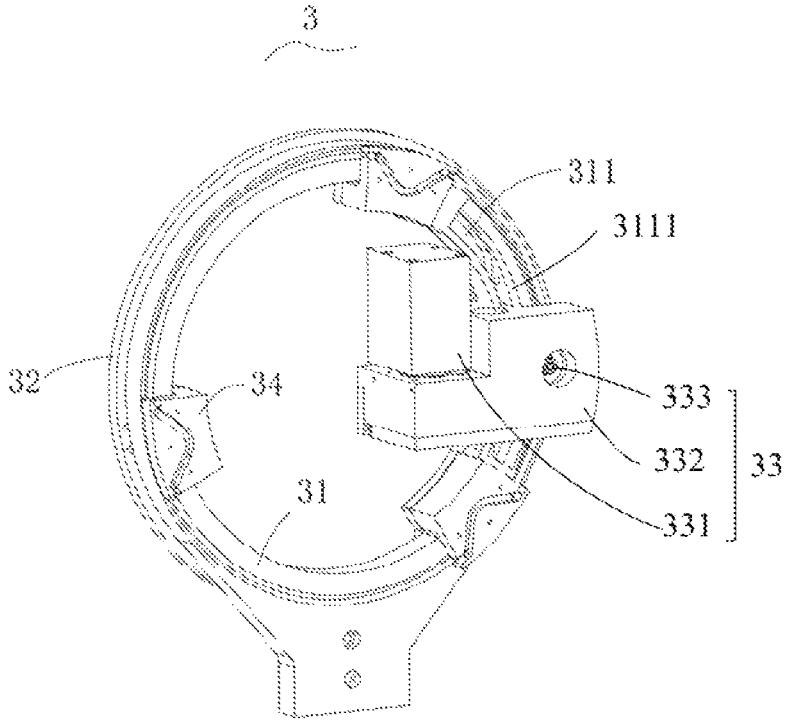
FIG. 2 is an axonometric diagram illustrating a Y-axis rotating mechanism in FIG. 1.

Optionally, as shown in FIG. 2, in the present embodiment, a bracket wall of the annular bracket 31 is radially provided with an arc-shaped long groove 311; a groove wall of the arc-shaped long groove 311 is provided with a rack 3111; and the rack 3111 engages with a driving wheel of the Y-axis driving mechanism 33. A locating seat 321 inwards extends on an inner side wall of the annular sliding cover 32; and the locating seat 321 is fastened to the Y-axis driving mechanism 33. Through such structural design, the rack 3111 is fixed to the groove wall of the arc-shaped long groove 311; and then the rack 3111 engages with a driving wheel of the Y-axis driving mechanism 33. Since the Y-axis driving mechanism 33 is fastened to the locating seat 321 that inwards extends on the inner side wall of the annular sliding cover 32, the annular sliding cover 32 and the Y-axis driving mechanism 33 integrally move along the circumferential direction of the annular bracket 31, and an angle of reciprocation is limited by the length of the rack 3111 arranged on the groove wall of the arc-shaped long groove 311. The Y-axis driving mechanism comprises a motor 331 and a gearbox 332, the motor 331 is disposed on the gearbox 332, the gearbox 332 comprises a driving wheel 333 connected to the motor 331.

Figure 3:
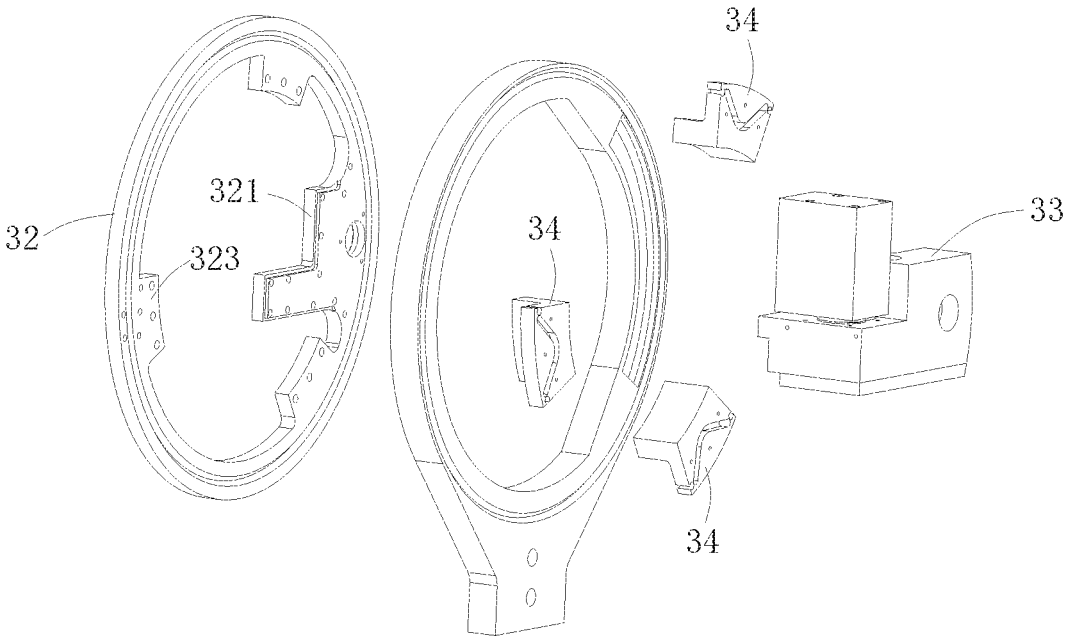
FIG. 3 is an exploded view illustrating the Y-axis rotating mechanism in FIG. 2.
Figure 4:
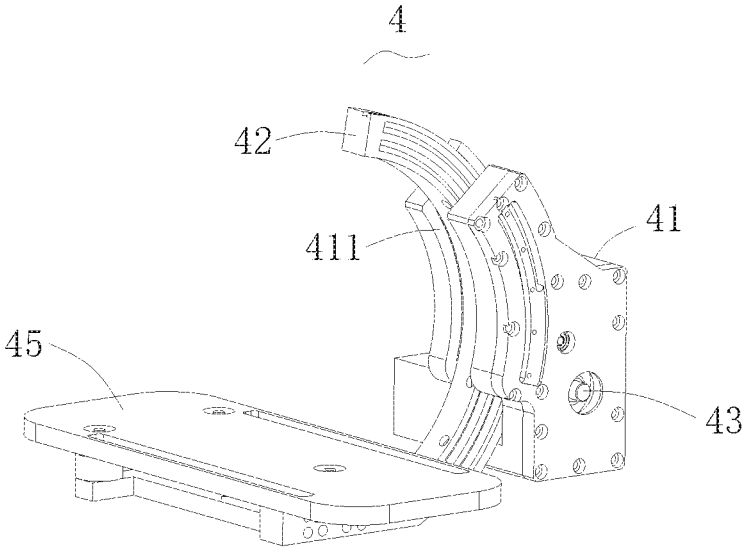
FIG. 4 is an axonometric diagram illustrating an X-axis rotating mechanism in FIG. 1.
Figure 5:
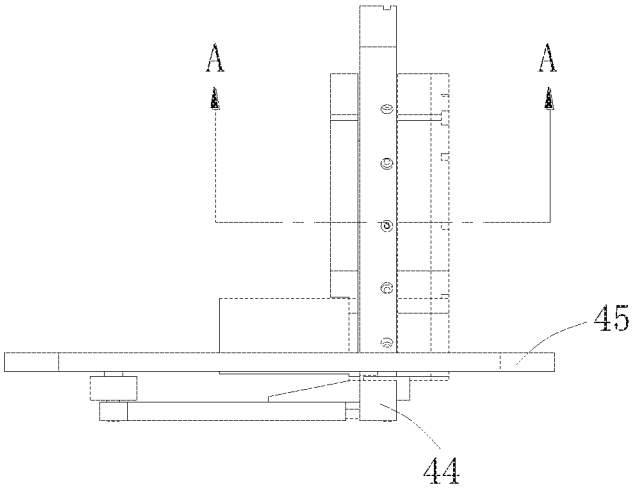
FIG. 5 is a front view illustrating the X-axis rotating mechanism in FIG. 4.

Optionally, as shown in FIG. 2 and FIG. 3, in order to slide the annular sliding cover 32 stably and reliably along the circumferential direction of the annular bracket 31, a plurality of locating bulges 323 are evenly arranged along the circumferential direction on an inner side wall of the annular sliding cover 32; and the locating bulges 323 are fastened to the sliding block 34 for locating the annular sliding cover 32. A plurality of first balls are annularly and evenly arranged between the annular sliding cover 32 and the annular bracket 31. The sliding block 34 has an L-shaped cross section. A first side wall of the sliding block 34 is located at an outer side of the annular bracket 31 and a plurality of second balls are annularly and evenly arranged between the first side wall and the annular bracket 31. An end of a second side wall of the sliding block 34 is fastened to the locating bulges 323. In the present embodiment, grooves for accommodating the first balls and the second balls are correspondingly arranged in a concave way in positive and negative side walls of the annular sliding cover 32 and the annular bracket 31, so that the annular sliding cover 32 slides stably and reliably along the circumferential direction of the annular bracket 31.

In the present embodiment, under an initial state, in order to relatively balance both sides of the annular sliding cover 32, the Y-axis driving mechanism 33 and the X-axis rotating mechanism 4 are arranged oppositely and are fastened to the annular sliding cover 32.

Figure 6:
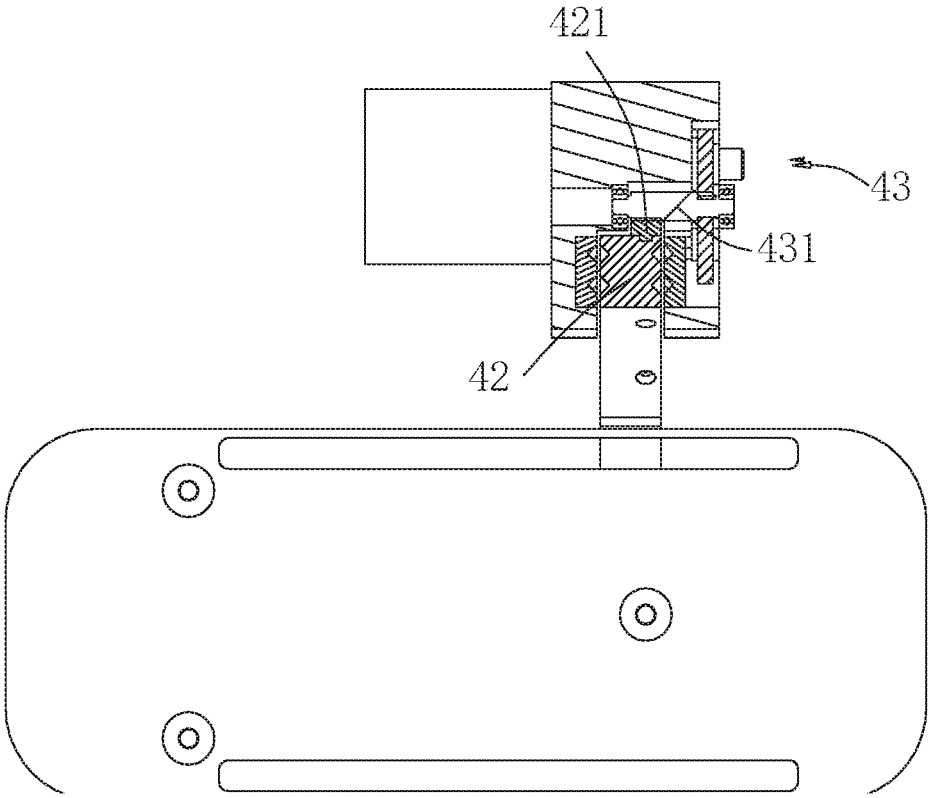
FIG. 6 is a section view illustrating A-A section in FIG. 5.

In the present embodiment, as shown in FIG. 1, FIG. 4, FIG. 5 and FIG. 6, the X-axis rotating mechanism 4 includes a base 41, an arc-shaped sliding rail 42 in sliding fit with a slipway 411 at one side of the base 41, an X-axis driving mechanism 43 arranged in the base 41 and used for driving the arc-shaped sliding rail 42 to reciprocate upwards and downwards along the slipway 411, and a supporting beam 44 horizontally extending on a lower end of the arc-shaped sliding rail 42 and used for erecting the pedal 45. The pedal 45 is horizontally erected on the supporting beam 44. Third balls are evenly arranged between both side walls of the arc-shaped sliding rail 42 and both side walls of the slipway 411. Similar to the above structure, grooves are correspondingly formed in opposed wall surfaces for accommodating third balls. As shown in FIG. 6, an arc-shaped rack 421 is arranged on an outer arc surface of the arc-shaped sliding rail 42, the arc-shaped rack 421 engages with the driving gear arranged on the driving shaft 431 of the X-axis driving mechanism 43 so as to drive the arc-shaped sliding rail 42 to move up and down and then drive the pedal 45 to move synchronously.

Figure 7:
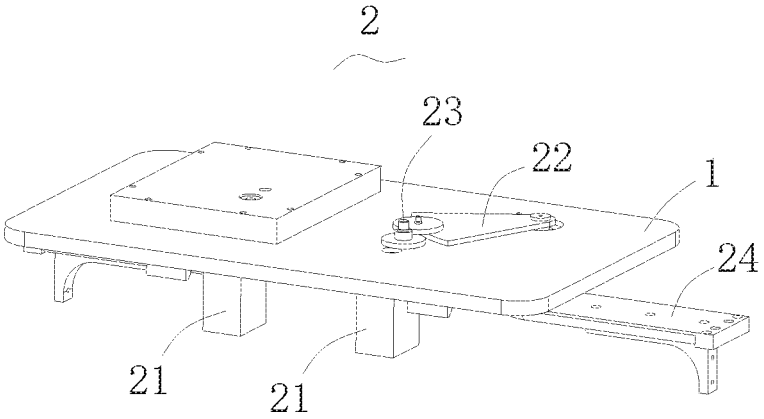
FIG. 7 is an axonometric diagram illustrating a lower bottom surface of a Z-axis rotating mechanism in FIG. 1.

In the present embodiment, as shown in FIG. 7, the Z-axis rotating mechanism 2 includes a driving motor 21, a fan-shaped driving handle 22 connected with a power output end of the driving motor 21, a driving shaft 23 buried in the working platform 1 and engaging with the fan-shaped driving handle 22, a torque sensor fitting an upper end of the driving shaft 23, and a driving arm 24 of the Z-axis rotating mechanism 2 fastened to the torque sensor. To enhance stability of placing the rehabilitation training apparatus for the ankle joint, in the present embodiment, the driving motor 21 fastened to the working platform is arranged on an upper surface of a desktop of the working platform 1, so as to reduce a spacing between a lower bottom surface of the working platform 1 and a placing surface. In addition, the arrangement of the fan-shaped driving handle 22 effectively enhances the stability in power transmission, and effectively saves material in comparison to the arrangement of a gear.

After the rehabilitation training apparatus for the ankle joint in the above structural design is connected with an external electric control apparatus, a foot is placed on the pedal 45, and a corresponding rotating mechanism is started as required, so as to continuously achieve movement of the ankle joint and then satisfy multi-freedom movement of the ankle joint, thereby effectively addressing many troubles caused by manual work which is adopted in traditional rehabilitation treatment and effectively ensuring adequate training time and adequate training intensity.

The present disclosure is described above in combination with optional embodiments. The description is only used to explain the present disclosure and is not interpreted as limitations to a protection scope of the present disclosure in any way.

INDUSTRIAL APPLICABILITY

The present disclosure provides a rehabilitation training apparatus for an ankle joint. The adoption of the above structural design enables to achieve multi-freedom movement of the ankle joint conveniently and rapidly, thus effectively increasing rehabilitation training efficiency.

What is claimed is:

1. A rehabilitation training apparatus for an ankle joint, comprising:

a working platform;

a Z-axis rotating mechanism erected on the working platform and rotating around a Z axis of the working platform;

a Y-axis rotating mechanism connected with the Z-axis rotating mechanism and rotating around a Y axis of the working platform;

an X-axis rotating mechanism connected with the Y-axis rotating mechanism and rotating around an X axis of the working platform; and a pedal arranged on a lower end of the X-axis rotating mechanism and parallel to a surface of the working platform, wherein the Y-axis rotating mechanism comprises an annular bracket vertically fastened to a driving arm of the Z-axis rotating mechanism, an annular sliding cover slidably disposed on one side wall of the annular bracket, a Y-axis driving mechanism for driving the annular sliding cover to rotate around an axis of the annular bracket, and a sliding block for locating the annular sliding cover relative to the annular bracket, wherein the Y-axis driving mechanism synchronously rotates with the annular sliding cover and the X-axis rotating mechanism is fastened to one side of the annular sliding cover;

wherein the Y-axis driving mechanism comprises a motor and a gearbox, wherein the motor is disposed on the gearbox, and the gearbox comprises a driving wheel connected to the motor.

2. The rehabilitation training apparatus for the ankle joint according to claim 1, wherein a bracket wall of the annular bracket is radially provided with an arc-shaped long groove; a groove wall of the arc-shaped long groove is provided with a rack; and the rack engages with the driving wheel of the Y-axis driving mechanism.

3. The rehabilitation training apparatus for the ankle joint according to claim 1, wherein a locating seat extends inward on an inner side wall of the annular sliding cover; the locating seat is fastened to the Y-axis driving mechanism; and the Y-axis driving mechanism is arranged oppositely to the X-axis rotating mechanism.

4. The rehabilitation training apparatus for the ankle joint according to claim 1, wherein a plurality of locating bulges are evenly arranged along a circumferential direction on an inner side wall of the annular sliding cover; and the locating bulges are fastened to the sliding block for locating the annular sliding cover relative to the annular bracket.

5. The rehabilitation training apparatus for the ankle joint according to claim 1, wherein the X-axis rotating mechanism comprises a base, an arc-shaped sliding rail in sliding fit with a slipway at one side of the base, an X-axis driving mechanism arranged in the base and used for driving the arc-shaped sliding rail to reciprocate upwards and downwards along the slipway, and a supporting beam horizontally extending on a lower end of the arc-shaped sliding rail and used for erecting the pedal.

6. The rehabilitation training apparatus for the ankle joint according to claim 5, wherein the pedal is horizontally erected on the supporting beam.

7. The rehabilitation training apparatus for the ankle joint according to claim 1, wherein the Z-axis rotating mechanism comprises a driving motor, a fan-shaped driving handle connected with a power output end of the driving motor, a driving shaft buried in the working platform and engaging with the fan-shaped driving handle, a torque sensor fitted on an upper end of the driving shaft, and a driving arm of the Z-axis rotating mechanism fastened to the torque sensor.

* * * * *